US011822291B2

(12) United States Patent
Loetscher et al.

(10) Patent No.: US 11,822,291 B2
(45) Date of Patent: Nov. 21, 2023

(54) WATCH EQUIPPED WITH A DEVICE FOR LOCKING AN EXTERNAL CONTROL UNIT

(71) Applicant: OMEGA SA, Bienne (CH)

(72) Inventors: Philippe Loetscher, Evilard (CH); Christophe Plancherel, Courroux (CH)

(73) Assignee: OMEGA SA, Biel/Bienne (CH)

( * ) Notice: Subject to any disclaimer, the term of this patent is extended or adjusted under 35 U.S.C. 154(b) by 65 days.

(21) Appl. No.: 17/555,824

(22) Filed: Dec. 20, 2021

(65) Prior Publication Data

US 2022/0260954 A1 Aug. 18, 2022

(30) Foreign Application Priority Data

Feb. 17, 2021 (EP) ..... 21157706
Feb. 22, 2021 (EP) ..... 21158506

(51) Int. Cl.
*G04B 3/04* (2006.01)
*G04B 19/18* (2006.01)
*G04B 19/28* (2006.01)

(52) U.S. Cl.
CPC ..... *G04B 3/043* (2013.01); *G04B 3/048* (2013.01); *G04B 19/18* (2013.01); *G04B 19/283* (2013.01)

(58) Field of Classification Search
CPC ..... G04B 3/043; G04B 3/048; G04B 19/283; G04B 37/106; G04B 19/18; G04B 37/08; G04B 37/10; G04F 7/0866; G04C 3/005
See application file for complete search history.

(56) References Cited

U.S. PATENT DOCUMENTS 10,345,762 B2 * 7/2019 Kissling ..... G04B 3/003
10,725,429 B2 * 7/2020 Loetscher ..... G04B 47/066
11,150,606 B2 * 10/2021 Loetscher ..... G04B 19/18

FOREIGN PATENT DOCUMENTS

EP 3 407 144 A2 11/2018
EP 3 407 144 A3 1/2019
EP 3 557 336 A1 10/2019
EP 3 650 951 A1 5/2020
JP 2005-337792 A 12/2005

OTHER PUBLICATIONS

European Search Report of EP 21 15 8506 dated Aug. 10, 2021.

* cited by examiner

*Primary Examiner* — Edwin A. Leon
(74) *Attorney, Agent, or Firm* — Sughrue Mion, PLLC

(57) ABSTRACT

A watch including a case (6) having a push-piece (8), movable in a radial direction, and a device (14) for locking the push-piece. The locking device includes a locking member (16) rotatably mounted about a central axis of the case and arranged to be actuated between a locking position, wherein the push-piece is stopped or blocked by the locking device so that the function cannot be activated by actuation of the control member, and an unlocking position wherein the push-piece is released and can then be actuated in said radial direction to allow the function to be activated. A rotating bezel (20) and the locking member are coaxial arranged so that they can each be rotatably actuated by the user independently of each other. Thus, the rotating bezel is independent of the locking function and can thus be dedicated to the chronograph mechanism and be in particular useful for diving.

14 Claims, 5 Drawing Sheets

WATCH EQUIPPED WITH A DEVICE FOR LOCKING AN EXTERNAL CONTROL UNIT

CROSS REFERENCE TO RELATED APPLICATIONS

This application claims priorities to European Patent Application No. 21157706.9, filed on Feb. 17, 2021 and European Patent Application No. 21158506.2, filed on Feb. 22, 2021, the entire contents of which are incorporated herein by reference.

TECHNICAL FIELD OF THE INVENTION

The present invention relates to a watch provided with a device for locking a control member that can be actuated by a user of the watch, in particular a push-piece associated with a chronograph mechanism.

TECHNOLOGICAL BACKGROUND

Patent application JP 2005-337792 describes a watch provided with a chronograph mechanism, associated with two push-pieces which can be actuated in a conventional manner by a user from outside the case, and with a device for locking these two push-pieces which comprises a locking ring arranged in an upper groove of the middle part of the watch so as to form a bezel surrounding the display area defined by the dial of the watch. The groove has at least one lateral opening to allow the gripping of the locking ring and its rotational actuation, so as to be able to drive the locking ring between at least one angular locking position and at least one angular unlocking position. The locking ring has distinct lower parts which extend over a plurality of angular sectors, leaving therebetween empty sectors, that is to say without material.

For each of the watch control members, namely the two push-pieces and a stem-crown, when the locking ring is in the corresponding locking angular position, one of the lower parts is located in a slot of the control member or behind an inner side surface of this control member, so as to block, respectively stop a translational movement in a corresponding radial direction and thus prevent activation of a corresponding function. For each of the watch control members, when the locking ring is located in the corresponding angular unlocking position, the control member is then located angularly facing an empty sector, so that this control member is free to move in the corresponding radial direction and that its translational actuation in this radial direction is then possible to activate the corresponding function.

The watch described above has various disadvantages. First, the locking ring forms a bezel of the watch and no other rotating bezel, in particular associated with the chronograph mechanism, is provided. Note that the arrangement of the locking ring is such that it effectively prevents equipping the watch with another rotating bezel which can be associated with a function other than the locking of at least one of the control members of this watch.

Then, two side openings are provided in the middle part to allow a gripping of the locking ring by a user and its rotational actuation. These two openings are unsightly and give the case a complex shape, which increases its manufacturing cost. In any case, the two lateral openings of the middle part oppose a harmonious shape of the case in its upper part, the case having a kind of step on its two lateral sides, and in addition this embodiment reveals, in a top view, the control members.

SUMMARY OF THE INVENTION

The purpose of the present invention is to provide a watch of the type described above with a device for locking at least one external control member whose arrangement is discreet, while allowing a user to actuate it easily. In addition, the purpose of the invention is to provide such a watch with a case provided with a rotating bezel which is associated with a function of the watch other than the locking described above.

Thus, the present invention relates to a watch comprising a horological movement and a case incorporating this horological movement and provided with a control member allowing to activate a function of the horological movement, this control member being movable in a radial direction and can be actuated by a user from outside the case, this case being further provided with a device for locking the control member. The locking device comprises a locking member which is rotatably mounted about a central axis of the case and which is arranged so as to be able to be actuated by the user of the watch between at least one angular locking position, wherein the control member is stopped or blocked by the locking device so that said function cannot be activated by actuation of this control member in said radial direction, and at least one angular unlocking position wherein the control member is released and can be actuated in said radial direction so as to allow said function to be activated. The watch further comprises a bezel rotating about said central axis, this rotating bezel and the locking member thus being coaxial. The rotating bezel and the locking member form two separate members and are arranged so that they can each be rotatably actuated, by a user, independently of each other.

Preferably, the locking member comprises an annular part, centred on said central axis, which is arranged between the rotating bezel and a middle part supporting this rotating bezel.

Thanks to the features of the invention, the locking device does not take the place of a rotating bezel conventionally associated with the chronograph mechanism. In addition, the locking device is, in the preferred variant, particularly discreet and barely visible from the top of the watch.

In a general embodiment, the rotating bezel is associated with the chronograph mechanism. In a particular embodiment, the watch is intended for diving.

In a preferred embodiment, the locking member comprises a gripping element integral with its annular part and located outside the middle part of the case so as to allow it to be gripped by a user, to be able to easily rotate, the locking member at least between the angular locking position and the angular unlocking position, obviously in both directions.

The control member is either a stem-crown allowing in particular a time setting of the watch, or a push-piece associated with at least one function of the watch. In the case of a conventional chronograph watch provided with two push-pieces, the locking device can be used to lock only one of the two push-pieces, in particular the one used to initiate and then complete the measurement of a time interval (a duration), or both push-pieces, simultaneously or separately. In an advanced variant, the locking device can be arranged so as to allow locking, depending on the angular position of the locking member, only the first push-piece, only the second push-piece and the two push-pieces. The locking device can even be used for locking the stem-crown, in particular in its winding position (that is to say not pulled out) in addition to that of at least one of the two push-pieces when the locking member is in a certain angular position.

In a particular embodiment relating to a diving watch provided with a valve, the locking device can be used to lock the valve in a screwed closed position, at least when the locking member is in a specific angular position. In this case, the locking device comprises a locking member which is rotatably mounted about a central axis of the case and which is arranged so as to be able to be actuated by the user of the watch between at least one angular locking position, wherein the valve is blocked by the locking device in a screwed closed position, and at least one angular unlocking position wherein the valve is released and can be unscrewed and actuated in said radial direction so as to allow its opening. In this embodiment, the locking device can also be used for locking a control member, as mentioned above, when the locking member is in said specific angular position or in at least one other angular position.

In an advantageous variant of the particular embodiment, the locking member comprises a lower part, in particular formed of several annular sectors separated by empty areas, which is integral with the annular part or formed by the latter, this lower part extending generally in an angular area less than 360° and forming a stop for a part of the valve movable in radial translation, this lower part being configured so as to block the valve, in said radial direction, in said screwed closed position, and thus prevent the opening of this valve, when the locking member is in said angular locking position and to leave the valve free to move in said radial direction when the locking member is in said angular unlocking position.

BRIEF DESCRIPTION OF THE FIGURES

The invention will be described in more detail below using the appended drawings, given by way of non-limiting examples, wherein.

DETAILED DESCRIPTION OF THE INVENTION

Figure 1B:
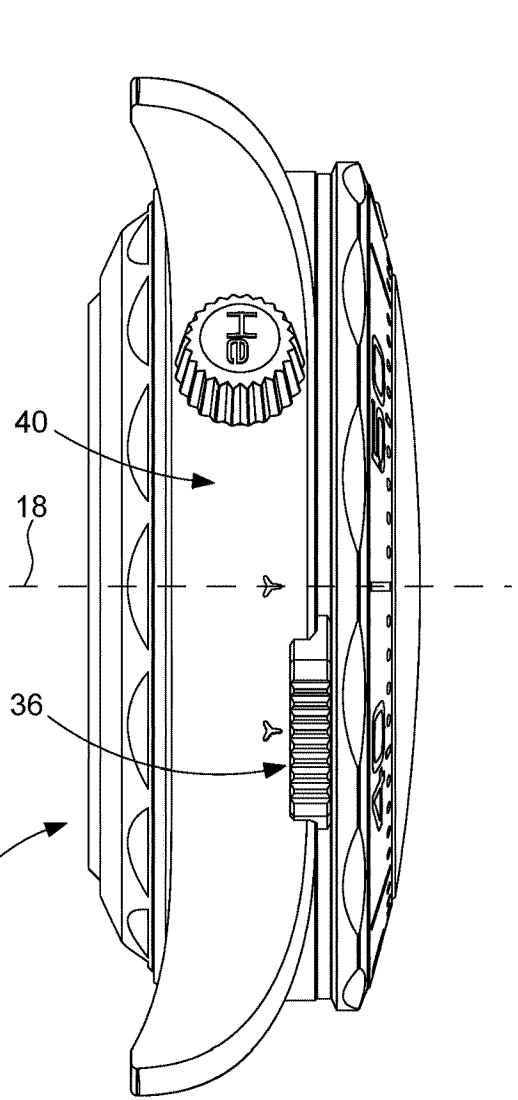
FIG. 1B is a side view of the watch of FIG. 1A.

With reference to the figures, a preferred embodiment of the invention will be described below, which incorporates several features of the invention which may, in other embodiments, be taken only partially. Watch 2 is in the variant shown a diving watch.

The watch 2 comprises a horological movement 4 and a case 6 which incorporates this horological movement, which comprises a chronograph mechanism. The case 6 is provided with several control elements, namely two push-pieces 8, 9 and a stem-crown 10, which respectively allow to activate different functions of the horological movement. In addition, the case is provided with a valve 7 because the watch shown is a diving watch. The valve and each of the control members is movable in a radial direction, 12 and 13 respectively for the push-pieces 8 and 9, and can be actuated by a user from outside the case. In particular, the valve 7 is screwed in its closed position. Subsequently, more particularly the push-piece 8 which is conventionally used for the 'chronograph' function of the chronograph mechanism, more specifically to start the measurement of a time interval and then to put an end to this measurement will be considered.

Figure 1A:
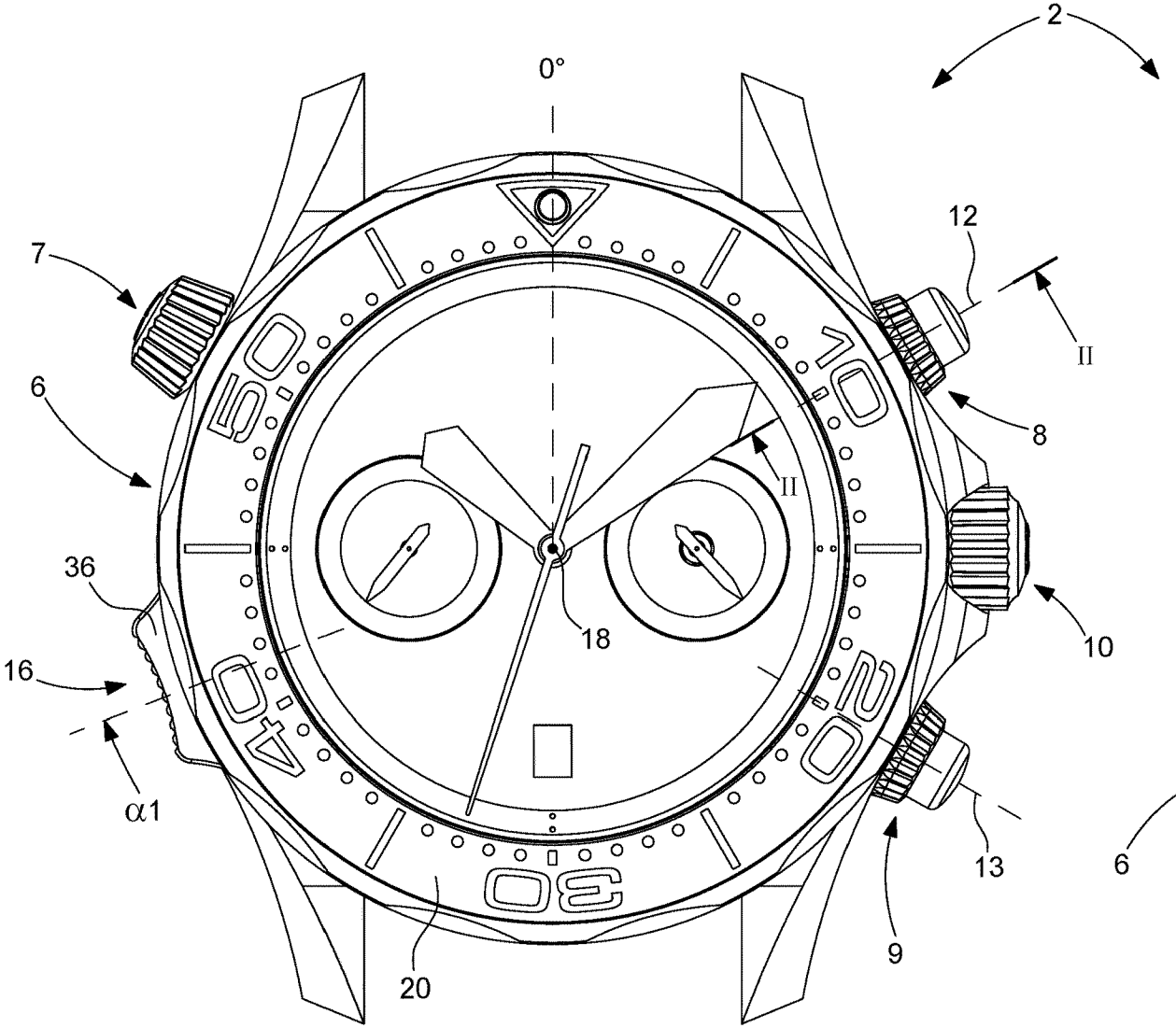
FIG. 1A is a top view of a watch according to an embodiment of the invention wherein the watch is intended for diving, the device for locking the push-pieces being in an angular locking position.
Figure 2:
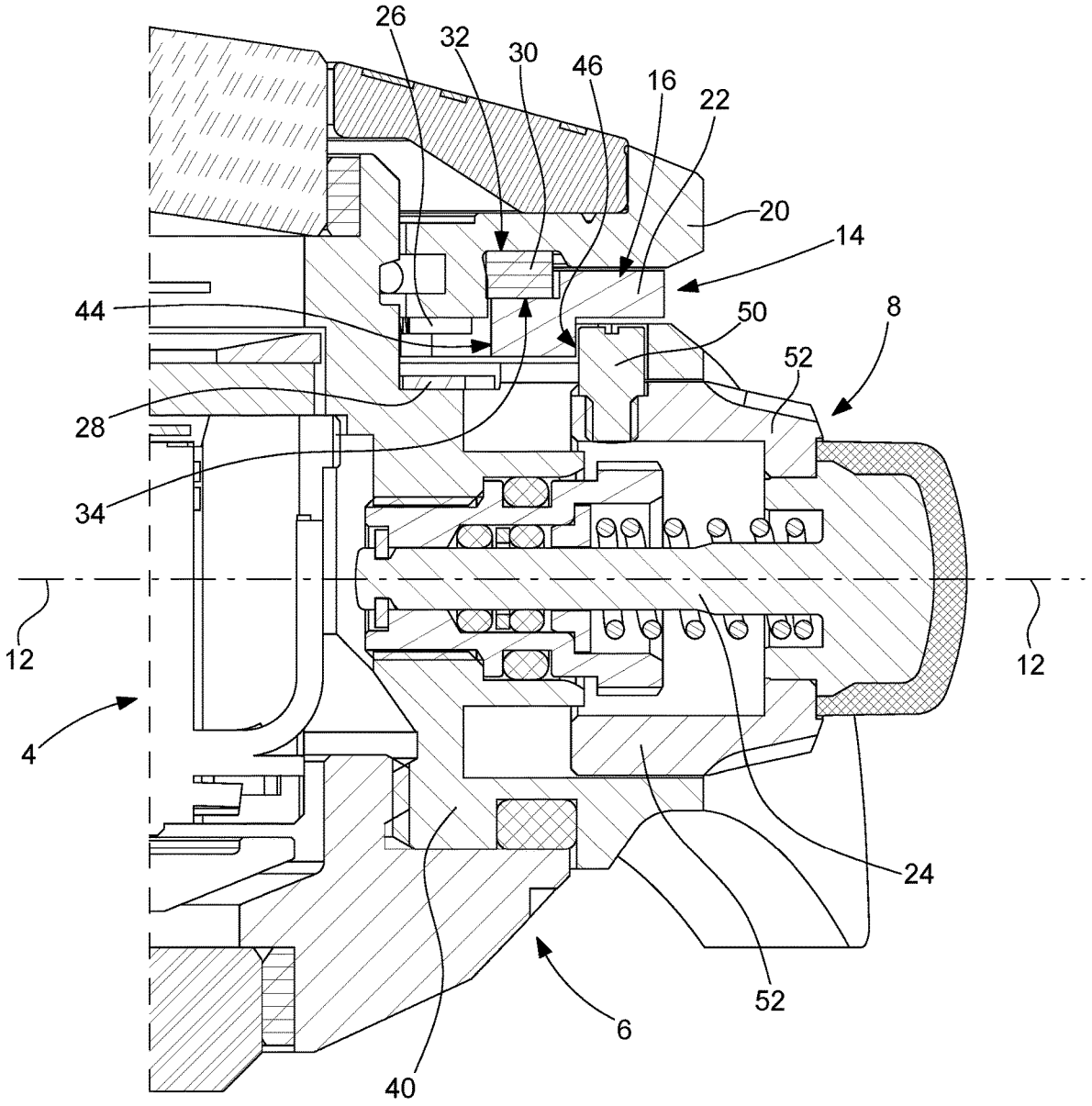
FIG. 2 is a partial cross section of the watch of FIG. 1A along section line II-II.

The case 6 is provided with a locking device 14 provided to be able to lock at least for the push-piece 8. This locking device comprises a locking member 16 which is rotatably mounted about a central axis 18 of the case and which is arranged so that it can be actuated by the user of the watch between at least one angular locking position $\alpha 1$ (state shown in FIG. 1), wherein the push-piece 8 is stopped or blocked by the locking device so that its function cannot be activated by actuation of this control member in the mentioned radial direction, and at least one angular unlocking position $\alpha 2$ (state shown in FIG. 2) wherein the push-piece 8 is released and can be actuated in this radial direction so as to allow the 'chronograph' function to be activated. The watch further comprises a bezel 20 rotating about the central axis 18, this rotating bezel and the locking member 16 thus being coaxial. The rotating bezel and the locking member are arranged so that they can each be rotatably actuated by the user independently of each other, that is to say be rotatably actuated independently of each other.

In the variant described, the rotating bezel 20 is associated with a useful function for diving. Advantageously, the locking member 16 comprises an annular part 22, centred on the central axis 18, which is arranged between the rotating bezel 20 and the middle part 40 of the case 6, more generally between the rotating bezel and a radial stem 24 of the push-piece 8. This arrangement allows to incorporate the locking member 16 for the most part inside the case 6, in particular the whole of said annular part, thus allowing the locking device to be discreet and barely visible from the top of the watch, that is to say from the side of the analogue display device.

The rotating bezel 20 comprises internal teeth 26 conventionally associated with a ratchet spring 28 for the angular positioning of this rotating bezel. According to another advantage of the proposed construction, the internal teeth 26 is located in a cylindrical space inside the locking member 16, in particular its annular part 22. In addition, the internal teeth are located substantially at the same level as the locking member 16, which allows to obtain a case whose height is not or only slightly increased by the incorporation of the locking device. Indeed, the concentric arrangement of the annular part 22 and the angular positioning device of the rotating bezel 20 allows to reduce the size of the locking device.

To prevent metal against metal friction, in particular steel against steel, between the lower part of the rotating bezel 20 and the annular part 22, an annular spacer 30 is arranged in an annular cavity defined by the rotating bezel and the annular part of the locking member, between the latter. This annular spacer has at least one sliding surface in contact with a lower surface 32 of the rotating bezel or with an upper surface 34 of the annular part, this sliding surface having a low coefficient of friction with this lower surface, respectively this upper surface. Preferably, the spacer 30 is mounted to rotate freely, that is to say that it is not fastened to the annular part or to the lower part of the rotating bezel. In this case, the spacer has a lower sliding surface in contact with the upper surface 34 and an upper sliding surface in contact with the lower surface 32. Advantageously, the spacer 30 is formed by polyoxymethylene (POM), in particular Delrin®. The coefficient of friction is approximately within the value range 0.20-0.35.

According to a preferred variant of the invention, the locking member 16 comprises a gripping element 36 which is integral with the annular part 22 and is located outside the middle part 40 of the case so as to easily allow its gripping by a user, in order to be able to rotate the locking member between the angular locking position $\alpha 1$ and the angular unlocking position $\alpha 2$. This gripping element is elegant and gives an additional technical character to the chronograph diving watch. It will be noted that in the variant shown in the figures, the annular part 22 of the locking member has a cylindrical side face which is visible laterally around its entire periphery.

In another variant, it is possible to provide that the annular part is entirely located inside the case and therefore not visible from the outside, except possibly at both ends of an angular area traversed by a part of connection between the gripping element and the annular part. In this last variant, to always hide the through-cavity wherein the connecting part is located and moves, it is advantageously possible to provide a relatively short angular path for the gripping element between the angular locking position $\alpha 1$ and the angular unlocking position $\alpha 2$ of the locking member, as well as an angular extent of the gripping element such that the latter covers said through-cavity regardless of the angular position of the locking member in the range of angular positions defined by these angular locking and unlocking positions. According to the variant shown, which allows easy actuation of the locking device with the user's thumb, the gripping element 36 is advantageously located in an angular sector comprised between 220° and 290°, calculated in the clockwise direction from the '12 o'clock' position, corresponding to 0°, over an hour revolution of '12 hours'. Preferably, the angular locking position $\alpha 1$ is located approximately between 240° and 250°, and the angular unlocking position $\alpha 2$ is equal to 270°. According to a more general variant, the gripping element 36 is located in an angular sector comprised between 150° and 300°.

Figure 3B:
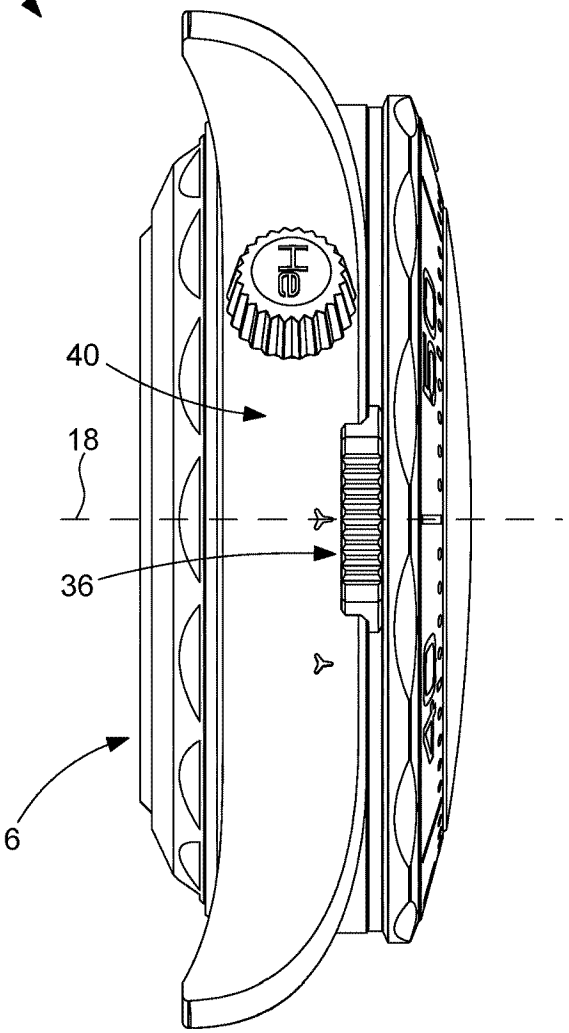
FIG. 3B is a side view of the watch of FIG. 3A.
Figure 3A:
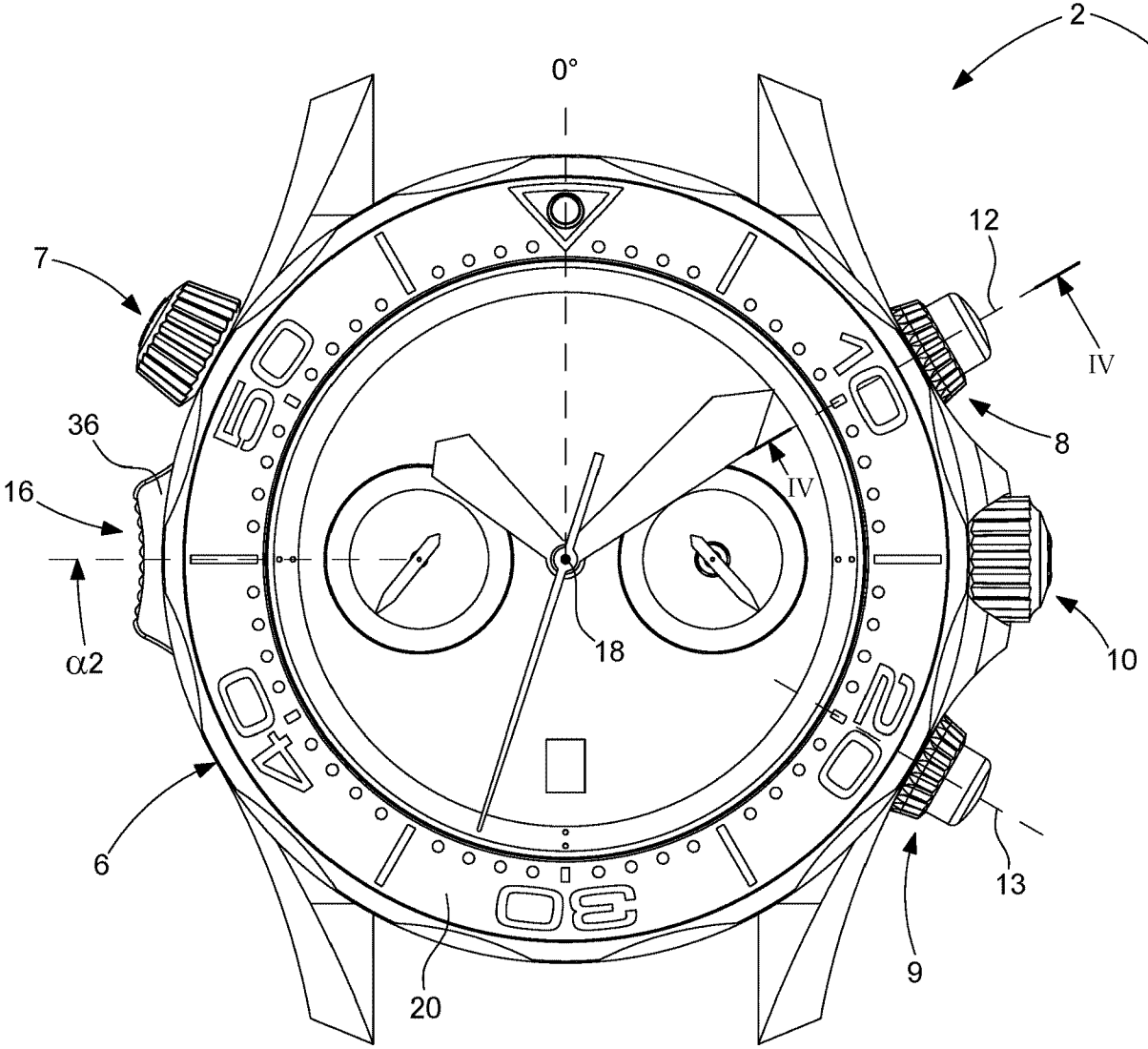
FIG. 3A is a top view of the watch of FIG. 1A with the device for locking the push-pieces in an angular unlocking position.
Figure 4:
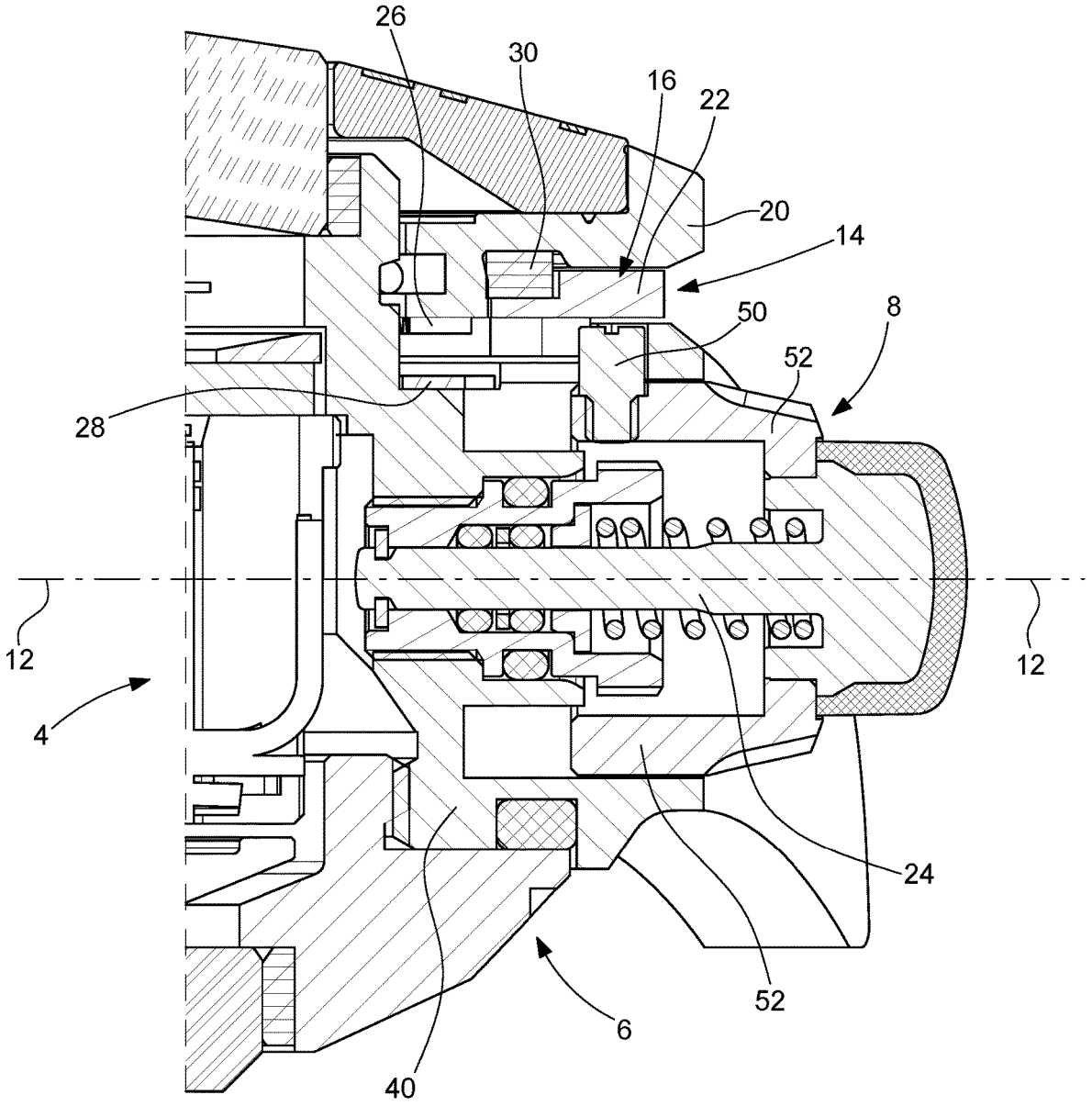
FIG. 4 is a partial cross section of the watch of FIG. 3A along section line IV-IV.
Figure 5:
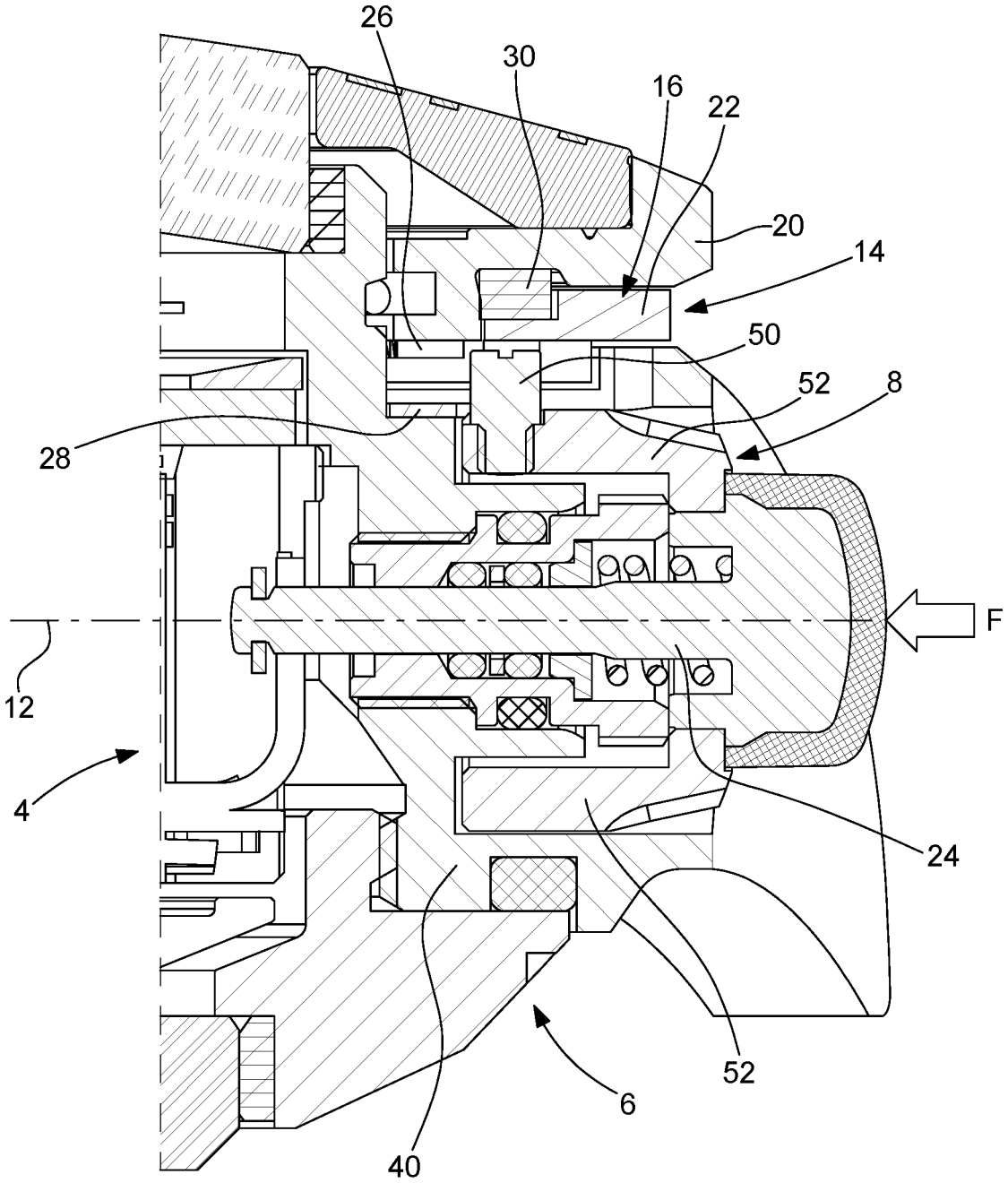
FIG. 5 is a partial cross section, similar to that of FIG. 4, of the watch of FIG. 3A where a released push-piece was actuated by the exertion of a radial force.

The way in which the locking and unlocking of the push-piece 8, but preferably of the two push-pieces 8 and 9 and optionally also of the valve 7 and of the stem-crown 10, is obtained with the locking device 14 according to the preferred embodiment described with reference to the figures, will be described below. The locking member 16 comprises a lower part 44 which is integral with the annular part or which is formed by the latter (that is to say made integrally with this annular part according to the variant shown), this lower part extending generally in an angular area which is less than 360° and having an outer lateral surface 46 which forms a stop for a part 50 of the push-piece 8 movable in radial translation. It will be noted that the lower part 44 is generally formed of several distinct annular sectors which are separated by empty areas. The lower part 44 is configured so as to stop, according to the variant shown, or to block, according to another variant wherein the lower part penetrates a circular slot machined in the body 52 of the push-piece 8, this push-piece 8 in the radial direction 12, to thus prevent an activation of the 'chronograph' function, when the locking member 16 is in the angular locking position (FIG. 1A, 1B and FIG. 2) and to leave the control member free to move in said radial direction when the locking member is in the angular unlocking position (FIG. 3A, 3B and FIG. 4). In this last position, the movable part 50 can displace in an inner cavity of the case 6, which is partially defined by an aforementioned empty sector, without being stopped or blocked in its radial translational movement to an end position, as shown in FIG. 5. In the movement of the push-piece between the state given in FIG. 4 and the state given in FIG. 5, conventionally performed by a radial force exerted by a user on the push-piece 8, the 'chronograph' function is carried out, namely either the engagement of the chronograph mechanism for triggering the measurement of a time interval, or the disengagement of this chronograph mechanism to complete this measurement.

The movable part 50 of the control member 8 is formed by an upper projecting part which rises above the body 52 of this control member to which it is fastened, in particular screwed, this body 52 protruding from the middle part 40 of the case 6 and being arranged in this middle part in a sliding manner along the radial direction 12. The upper projecting part is arranged at the lower part 44 of the locking member 16 and it is advantageously housed in an internal cavity of the case, that is to say it is located inside this case.

The invention claimed is:

1. A watch comprising:

a horological movement; and a case incorporating the horological movement and provided with a control member allowing to activate a function of the horological movement, the control member being movable in a radial direction and configured to be actuated by a user from outside the case, the case being further provided with a locking device for locking the control member, the locking device comprising a locking member which is rotatably mounted about a central axis of the case and which is arranged so as to be able to be actuated by the user of the watch between at least one angular locking position, wherein the control member is stopped or blocked by the locking device so that said function cannot be activated by actuation of the control member in said radial direction, and at least one angular unlocking position wherein the control member is released and can be actuated in said radial direction so as to allow said function to be activated, and wherein the watch further comprises a bezel rotating about said central axis, the rotating bezel and the locking member thus being coaxial, the rotating bezel and the locking member being arranged so as to be rotatably actuated by the user independently of each other.

2. The watch according to claim 1, wherein the locking member comprises an annular part, centred on said central axis, which is arranged between the rotating bezel and a middle part supporting the rotating bezel.

3. The watch according to claim 2, wherein the rotating bezel comprises internal teeth associated with a ratchet spring for the angular positioning of the rotating bezel, the internal teeth being located in a cylindrical space inside the locking member.

4. The watch according to claim 2, wherein the watch comprises an annular spacer which is arranged in an annular cavity defined by the rotating bezel and the annular part of the locking member, the annular spacer having at least one sliding surface in contact with a lower surface of the rotating bezel or with an upper surface of said annular part, the sliding surface having a low coefficient of friction with the lower surface, respectively the upper surface.

5. The watch according to claim 1, wherein the locking member comprises a gripping element which is integral with said annular part and located outside the middle part of the case so as to allow it to be gripped by a user to be able to rotate the locking member at least between said angular locking position and said angular unlocking position.

6. The watch according to claim 5, wherein the gripping element is located in an angular sector comprised between 220° and 290° calculated in the clockwise direction from the 12 o'clock position over an hour revolution of 12 hours.

7. The watch according to claim 1, wherein the locking member comprises a lower part formed of several annular sectors separated by empty areas, which is integral with the annular part or formed by the latter, the lower part extending generally in an angular area less than 360° and having an outer lateral surface which forms a stop for a part of the control member movable in radial translation, the lower part being configured so as to stop or block the control member in said radial direction, and thus prevent activation of said function, when the locking member is in said angular locking position and to leave the control member free to move in said radial direction when the locking member is in said angular unlocking position.

8. The watch according to claim 7, wherein said part movable in radial translation is an upper projecting part which rises above a body of the control member to which it is fastened, by screwing, the body protruding from the middle part of the case and being arranged in the middle part in a sliding manner along said radial direction, the upper projecting part being arranged at said lower part of the locking member and housed in a cavity located inside the middle part.

9. The watch according to claim 1, wherein the horological movement comprises a chronograph mechanism, said function being a chronograph function of the chronograph mechanism and said control member forming a push-piece associated with the chronograph mechanism.

10. The watch according to claim 9, wherein the watch is a diving watch, said rotating bezel being associated in particular with a function useful for diving.

11. A watch comprising:

a horological movement; and a case incorporating the horological movement and provided with a valve, the valve being movable in a radial direction and configured to be actuated by a user from outside the case, the case being further provided with a device for locking the valve, the locking device comprising a locking member which is rotatably mounted about a central axis of the case and which is arranged so that it can be actuated by the user of the watch between at least one angular locking position, wherein the valve is blocked by the locking device in a screwed closed position, and at least one angular unlocking position wherein the valve is released and can be unscrewed and actuated in said radial direction so as to allow its opening, and wherein the watch further comprises a bezel rotating about said central axis, the rotating bezel and the locking member thus being coaxial, the rotating bezel and the locking member being arranged so as to be rotatably actuated by the user independently of each other.

12. The watch according to claim 11, wherein the locking member comprises an annular part, centred on said central axis, which is arranged between the rotating bezel and a middle part supporting the rotating bezel.

13. The watch according to claim 11, wherein the locking member comprises a gripping element which is integral with said annular part and located outside the middle part of the case so as to allow it to be gripped by a user to be able to rotate the locking member at least between said angular locking position and said angular unlocking position.

14. The watch according to claim 11, wherein the locking member comprises a lower part formed of several annular sectors separated by empty areas, which is integral with the annular part or formed by the latter, the lower part extending generally in an angular area less than 360° and forming a stop for a part of the valve movable in radial translation, the lower part being configured so as to block the valve, in said radial direction, in said screwed closed position, and thus prevent the opening of the valve, when the locking member is in said angular locking position and to leave the valve free to move in said radial direction when the locking member is in said angular unlocking position.

* * * * *